US009855190B2

(12) United States Patent
Knutson et al.

(10) Patent No.: US 9,855,190 B2
(45) Date of Patent: Jan. 2, 2018

(54) CHILD-RESISTANT, SENIOR-FRIENDLY PACKAGE

(71) Applicant: AndersonBrecon Inc., Rockford, IL (US)

(72) Inventors: Curtis Knutson, Loves Park, IL (US); Thomas Moyer, Freeport, IL (US); Tyler Prince, Charlotte, MI (US)

(73) Assignee: AndersonBrecon Inc., Rockford, IL (US)

( * ) Notice: Subject to any disclaimer, the term of this patent is extended or adjusted under 35 U.S.C. 154(b) by 145 days.

(21) Appl. No.: 13/862,730

(22) Filed: Apr. 15, 2013

(65) Prior Publication Data

US 2014/0305834 A1 Oct. 16, 2014

(51) Int. Cl.

| | |
|---|---|
| ***B65D 83/00*** | (2006.01) |
| ***A61J 1/03*** | (2006.01) |
| ***B65D 75/32*** | (2006.01) |
| ***B65D 83/04*** | (2006.01) |
| ***B65D 50/06*** | (2006.01) |

(52) U.S. Cl.

CPC ..... *A61J 1/035* (2013.01); *B65D 50/06* (2013.01); *B65D 75/327* (2013.01); *B65D 83/0463* (2013.01); *B65D 2215/04* (2013.01)

(58) Field of Classification Search

CPC ..... B65D 83/0463; B65D 83/0409; B65D 83/0418; B65D 83/0445; B65D 77/046; B65D 5/4229; B65D 5/703; B65D 5/725; B65D 75/5833; A61J 1/035

USPC ..... 206/528, 531–534, 534.1, 538

See application file for complete search history.

(56) References Cited

U.S. PATENT DOCUMENTS

| | | | | | |
|---|---|---|---|---|---|
| 3,305,077 | A * | 2/1967 | Greif | A61J 1/035 | 116/308 |
| 4,125,190 | A * | 11/1978 | Davie, Jr. | B32B 3/28 | 156/290 |
| 4,537,312 | A * | 8/1985 | Intini | B65D 75/327 | 206/484 |
| 5,042,472 | A * | 8/1991 | Bunin | A61M 15/0028 | 128/203.12 |
| 5,150,793 | A * | 9/1992 | Tannenbaum | 206/531 | |
| D337,725 | S * | 7/1993 | Bunin | D3/203.3 | |
| 5,339,960 | A * | 8/1994 | Price | 206/531 | |
| 5,549,204 | A * | 8/1996 | Toren | B65D 75/327 | 206/469 |

(Continued)

*Primary Examiner* — Anthony Stashick
*Assistant Examiner* — Ernesto Grano
(74) *Attorney, Agent, or Firm* — Howson & Howson LLP

(57) ABSTRACT

A package for containing tablets or like items is provided and has child-resistant and senior-friendly dispensing properties. The package includes an outer sleeve having opposed first and second wall panels. The first wall panel has a series of separate tear-away tabs. A separate card is contained within the sleeve and has a plurality of separate compartments and at least one reinforcement rib. A series of separate push-through chads is provided by the packaging and are directly opposed from and aligned with the tabs. The reinforcement rib provides a column support between the first and second wall panels and is of a height greater than that of the compartments. Each compartment is located directly between and aligned with one of the chads and one of the tabs, and the reinforcement rib provides a pre-determined amount of spacing between the tabs and the compartments.

5 Claims, 3 Drawing Sheets

(56) References Cited

U.S. PATENT DOCUMENTS

| | | | | |
|---|---|---|---|---|
| 7,000,769 | B2 * | 2/2006 | Killinger | 206/534 |
| 7,331,460 | B2 * | 2/2008 | Barndt et al. | 206/531 |
| 7,735,650 | B2 * | 6/2010 | Zumbiel | 206/532 |
| D623,948 | S * | 9/2010 | Levy | D9/457 |
| 7,798,328 | B2 * | 9/2010 | Hession | B65D 5/38 206/531 |
| 7,896,161 | B2 * | 3/2011 | Reilley et al. | 206/531 |
| 8,066,121 | B2 | 11/2011 | Sack et al. | |
| 8,079,475 | B2 * | 12/2011 | McArthur et al. | 206/532 |
| 8,091,708 | B2 * | 1/2012 | Loftin | A61J 1/035 206/528 |
| 8,328,018 | B2 | 12/2012 | Sack et al. | |
| 2003/0209558 | A1 * | 11/2003 | Cross | 221/25 |
| 2005/0274643 | A1 * | 12/2005 | Arnold | 206/531 |
| 2007/0151894 | A1 * | 7/2007 | Gherdan et al. | 206/531 |
| 2008/0093252 | A1 * | 4/2008 | Hession | 206/531 |
| 2008/0202972 | A1 * | 8/2008 | Prud'Homme | 206/531 |
| 2008/0277311 | A1 * | 11/2008 | Wang | A61J 1/03 206/570 |
| 2009/0107873 | A1 * | 4/2009 | Cotton | B65D 75/327 206/531 |
| 2009/0301924 | A1 * | 12/2009 | Rondeau | 206/531 |
| 2010/0084308 | A1 * | 4/2010 | Rigby | 206/531 |
| 2011/0210036 | A1 * | 9/2011 | Jones | 206/531 |
| 2014/0339121 | A1 * | 11/2014 | Gelardi | A61J 1/035 206/462 |

* cited by examiner

FIG.3
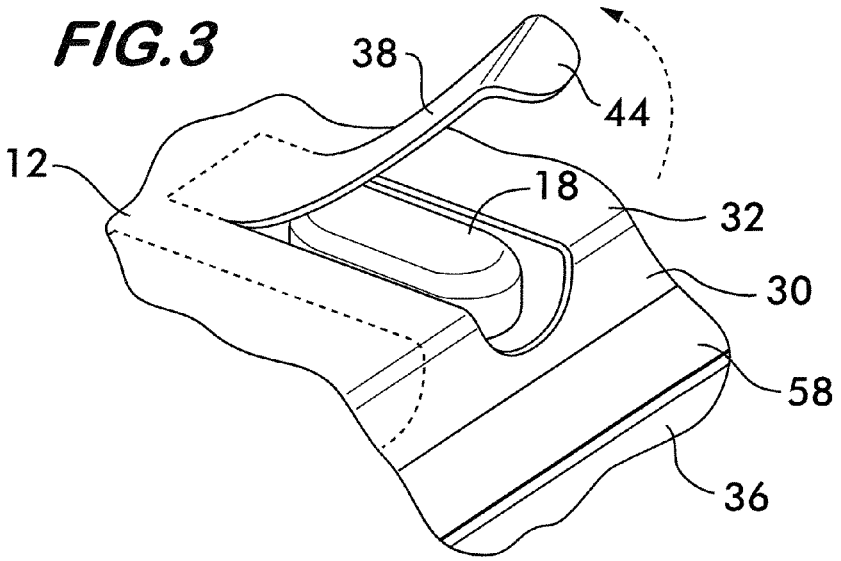
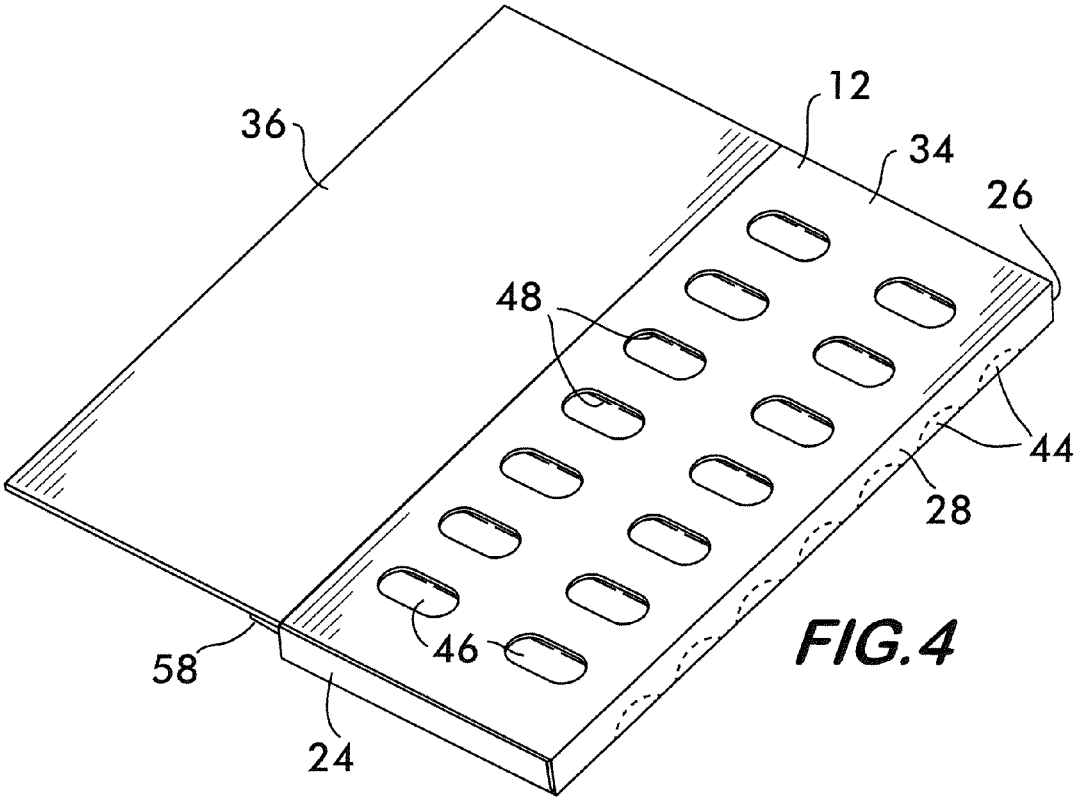
FIG.4

CHILD-RESISTANT, SENIOR-FRIENDLY PACKAGE

BACKGROUND

The present invention relates to a package for containing separate items, such as pills, tablets, doses of medicine, or the like, and more particularly, the present invention relates to a package including an outer sleeve, carton, or case housing a blister card in a manner providing child-resistant, senior-friendly dispensing properties.

By way of general example, paperboard packages including a blister card are disclosed by U.S. Pat. Nos. 7,896,161 B2 issued to Reilley et al. and 8,066,121 B2 issued to Sack et al. which are assigned to AndersonBrecon Inc., the assignee of the present application.

Although the above referenced paperboard packages may be satisfactory for their intended purpose, additional package designs able to provide desired dispensing properties and enabling cost efficient manufacture are desired.

BRIEF DESCRIPTION OF THE DRAWINGS

The present invention should become apparent from the following description when taken in conjunction with the accompanying drawings, in which:

FIG. 3 is a magnified perspective view of a tear-away tab of the package of FIG. 1 according to an embodiment;

FIG. 4 is perspective view of the package of FIG. 1 with a cover flap pivoted to a position enabling dispensing according to an embodiment;

DETAILED DESCRIPTION

Figure 1:
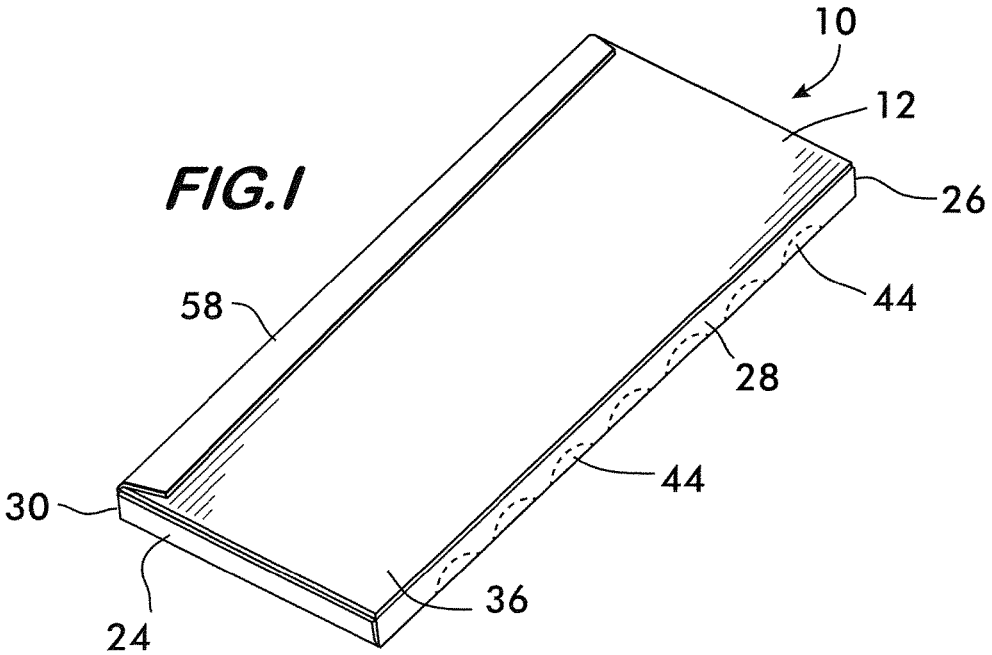
FIG. 1 is perspective view of a package in a sealed condition according to an embodiment.
Figure 2:
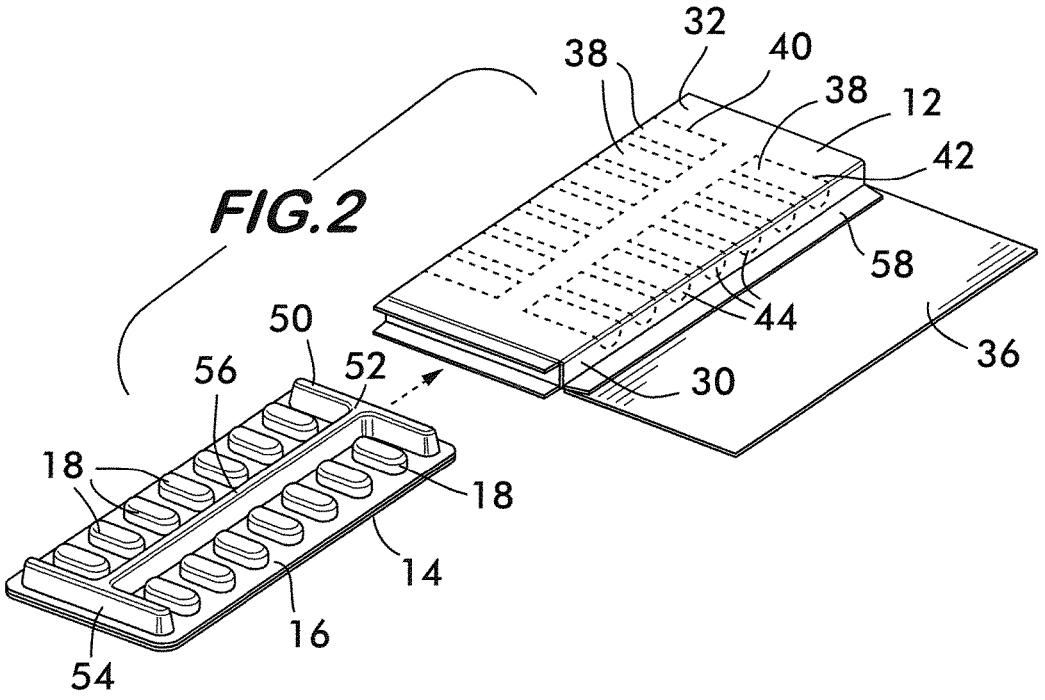
FIG. 2 is a perspective view of the package of FIG. 1 prior to insertion of a blister card into an outer sleeve according to an embodiment.

A fully assembled package 10 according to an embodiment is shown in FIG. 1. The package 10 can be relatively thin, elongate, and rectangular as shown in FIG. 1 or could be produced in other shapes or configurations. The package 10 includes a hollow outer sleeve 12 forming a protective carton or case that is shaped to house a separately-manufactured blister card 14 such as shown in FIG. 2.

Typically, the package 10 is provided of a size that can be readily held in the hand of an intended end user and that contains a predetermined number of doses or tablets. By way of example, the blister card 14 in the illustrated embodiment is designed to contain fourteen tablets 20 in fourteen separate blister compartments 18. Of course, the number, shape, pattern, and size of blister compartments 18 and tablets 20 can be altered from that illustrated.

The package 10 as shown in FIG. 1 is structured such that tablets 20 can be readily dispensed from the package 10 via a sequence of manipulations by the fingers of an intended end user, such as a senior citizen. However, the structure of the package 10 and sequence of steps required to dispense a tablet 20 is such that the package 10 provides a desired level of child-resistance whereby unintended persons, such as young children, cannot perform the sequence of manipulations and dispense a tablet 20 from the package 10. The child resistance is desired for a new package containing a complete set of tablets as well for a partially used package from which one or more tablets have been dispensed.

The blister card 14 may be provided in various forms. In the illustrated embodiment, the blister card 14 is made from a generally planar card 16 molded in a manner forming a plurality of integral, separate, spaced-apart, upstanding blister compartments 18 providing a plurality of separate hollow compartments in which a tablet, pill or other small article 20 can be loaded. A backing 22 can be applied to the card 16 to seal tablets 20 loaded on the blister card 14 in the upstanding blister compartments 18.

The plurality of separate blister compartments 18 permit a tablet 20 to be dispensed from one compartment 18 without disturbing the other blister compartments 18 of the blister card and the remaining tablets 20 stored on the blister card. The card 16 and blister compartments 18 can be formed of a thermoplastic material that may be transparent and the backing 22 may be formed of a thin layer of foil and/or a layer of paperboard having push through chads formed therein as discussed in greater detail below. Of course, other materials and blister card configurations and structures may be used.

In FIG. 1, the blister card 14 is fully stored and protected in the outer sleeve 12. In this condition the outer sleeve 12 prevents access to the blister card 14, compartments 18, and tablets 20. The outer sleeve 12 may comprise opposed end-walls 24 and 26 formed by end wall flaps or the like and opposed sidewalls, 28 and 30. The outer sleeve 12 also includes a first wall panel 32 which extends adjacent the tops of the blister compartments 18 of the blister card 14 and a second wall panel 34 which engages the backing 22 of the blister card 14. A cover flap 36 may also extend from and be formed integral with the outer sleeve 12.

Before the blister card 14 is inserted into the outer sleeve 12 (see FIG. 2), the sidewalls 28 and 30 and one of the end-walls, 24 or 26, may be sealed in a closed condition. After the blister card 14 shown in FIG. 2 is inserted into an open one of the end-walls, 24 or 26, the open end-wall may be sealed closed thereby capturing the blister card 14 in the sealed outer sleeve 12 and forming a closed carton or case about the blister card 14. The blister card 14 remains sealed within the outer sleeve 12 in a stationary position relative to the outer sleeve 12 throughout the full use of the package 10.

The first wall panel 32 includes a plurality of separate, individual, spaced-apart tear-away tabs 38. The tabs 38 may form part of the panel 32 and be defined therein by a pattern of perforations. In the illustrated embodiment, a total of fourteen separate tabs 38 are provided in two rows, 40 and 42, with seven tabs 38 in each row and correspond to the positions of the blister compartments 18 on the blister card 14 as retained in the outer sleeve 12. Accordingly, each tab 38 is positioned such that is extends directly above or is vertically aligned with one of the upstanding blister compartments 18 within the outer sleeve 12.

Each tab 38 may also have an end portion 44 extending on one of the sidewalls 28 and 30 of the outer sleeve 12 for providing a ready means for initiating removal of a tab 38 by the end user. The end portion 44 enables a finger of the user to push a tip of the tab 38 on a sidewall of the outer sleeve 12 inwardly to fracture the tip of the tab 38 so that the tab 38 can then be pinched or gripped and peeled away from the surrounding first wall panel 32 as shown, for instance, by FIG. 3 and the dashed arrow in FIG. 3.

As stated above, each tab 38 is located such that it is aligned with a top of one of the upstanding blister compartments 18 of the blister card 14. Thus, as best shown in FIG. 3, when one of the tabs 38 is partially torn away from or removed from the first wall panel 32, one of the blister compartments 18 becomes visible and accessible by a finger of the user. In the illustrated example, there are fourteen separate blister compartments 18 on the blister card 14 and there are fourteen corresponding tabs 38 with each tab 38 corresponding to one, and only one, of the blister compartments 18. Thus, when one tab 38 is torn away, access is provided only to the one corresponding blister compartment 18 and not to any other blister compartment 18 or tablet.

In a likewise manner, a series of separate push-through, break-away chads 46 may be formed in the backing 22 or on the second wall panel 34. For example, the chads 46 may be formed on the backing 22 the second wall panel 34 may be provided with a series of apertures aligned with the chads 46. Alternatively, the chads may be formed in the second wall panel 34. As a further alternative, the second wall panel could comprise two panels folded together with an inner panel including the chads and an outer panel including apertures. Each chad 46 is positioned such it aligns with one of the blister compartments 18. Each chad 46 is designed to require a pre-determined amount of force to be applied thereto (i.e., by pushing downwardly on the top of the blister compartment 18 and tablet 20) before the chad ruptures and permits a tablet 20 to pass through the second wall panel 34.

In the illustrated embodiment, each chad 46 is defined by a series or pattern of perforations 48. Accordingly, the material and thickness of the material of the backing 22 and/or the second wall panel 34 and the pattern and shape of the perforations 48 defining each chad 46 can be selected to ensure that the chad 46 does not rupture until a pre-determined amount of force is applied. For example, each chad 46 can be designed to break when a minimum of about ten to about fourteen pounds of pressure is applied to the chad 46 via finger pressure applied in a downward direction on the corresponding blister compartment 18 and tablet 20 via the opening provided by a removed tab 38.

Accordingly, for purposes of dispensing a tablet 20 from a blister compartment 18, a tab 38 corresponding to the blister compartment location is removed from the first wall panel 32 to enable access to the upstanding blister compartment (opposite the backing 22). The user then applies an appropriate amount of force on the blister compartment 18 to push the tablet 20 such that it breaks through the corresponding chad 46 and exits the package 10 through the broken chad location. These tasks and the dexterity needed to accomplish these tasks in sequence are not readily able to be accomplished by a young child, but can be readily accomplished by an adult or senior citizen.

After a first tablet is dispensed, the remaining tablets remain protected within the outer sleeve 12 and are not accessible via the previously removed tab 38 or pushed through chad 46. For purposes of dispensing a second tablet, the above steps need to be performed again (tab removal followed by pressure applied on exposed blister compartment to rupture the backing and corresponding chad). This sequence of steps is required to be repeated for each tab/blister compartment/chad combination. Thus, the removal of one or more tablets does not destroy the child-resistance dispensing property for tablets remaining within the package 10.

The cover flap 36 extending from the outer sleeve 12 provides an additional mechanism for preventing undesired dispensing of tablets 20 from the package 10. The flap 36 can be pivoted between positions permitting and preventing tablets 20 to be dispensed from the package 10. For instance, in a closed position as shown in FIGS. 1 and 5-7, the cover flap 36 engages directly against the second wall panel 34 and prevents the chads 46 from being pushed through and ruptured. In this condition, a tablet 20 cannot be dispensed even if a tab 38 is removed and pressure is applied to a blister compartment 18. In the closed position, the cover flap 36 also protects and conceals the chads 46 from direct engagement by the fingers or teeth of a young child. The cover flap 36 may be maintained in the closed position via use of adhesive tape, interacting locking tabs, hook-and-loop fasteners, or other re-sealable fastening mechanisms.

When dispensing is desired, the cover flap 36 must first to be unlocked and pivoted to the open position as shown in FIGS. 2 and 4. In the open position, the cover flap 36 does not engage the second wall panel 34 and a chad 46 can be pushed through and ruptured provided a sufficient amount of force is applied to an accessible blister compartment 18.

Accordingly, dispensing requires the following steps: the cover flap 36 being pivoted away from the second wall panel 32; a tab 38 being peeled away to expose a blister compartment 18; and a sufficient amount of pressure being applied to the blister compartment 18 needed to push through a tablet to rupture the corresponding chad 46.

As best shown in FIG. 2, the blister card 14 can include an upstanding reinforcement rib 50 for purposes of rigidifying the package 10, preventing damage when pressure is applied to a blister compartment 18, and for ensuring that the package functions as discussed above. As shown in FIGS. 2 and 5-7, the rib 50 can include a pair of opposed, laterally-extending, elongate end portions, 52 and 54 providing structural support transversely at the ends of the package 10 and an elongate spine portion 56 providing structural support along the length of the package 10 between the opposite ends thereof and between the two rows of blister compartments 18. In the illustrated embodiment, the rib 50 is continuous and is provided in the shape of an "I" as shown in FIG. 2. As an alternative, the rib 50 could be formed of several discontinuous sections.

Figure 5:
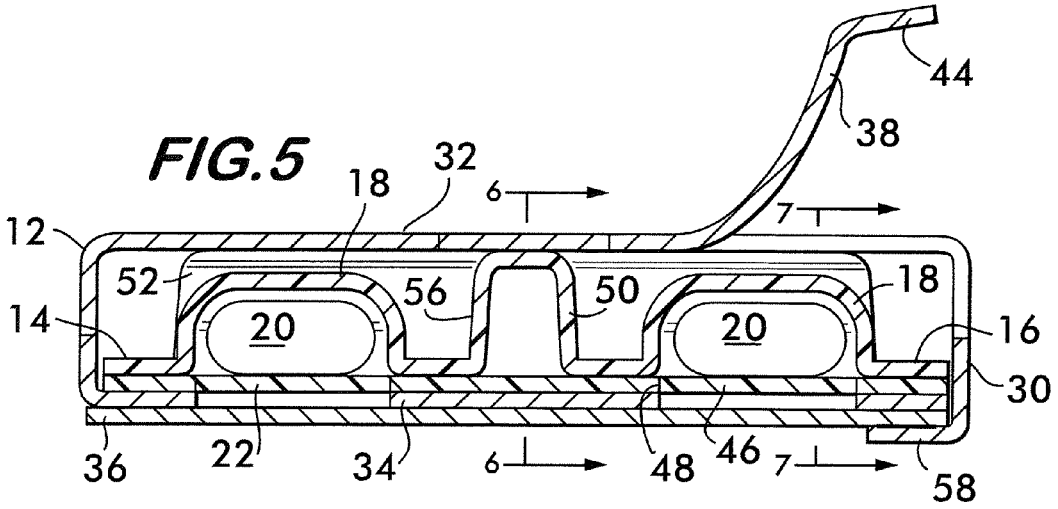
FIG. 5 is a cross-sectional view of the package of FIG. 1 according to an embodiment.
Figure 6:
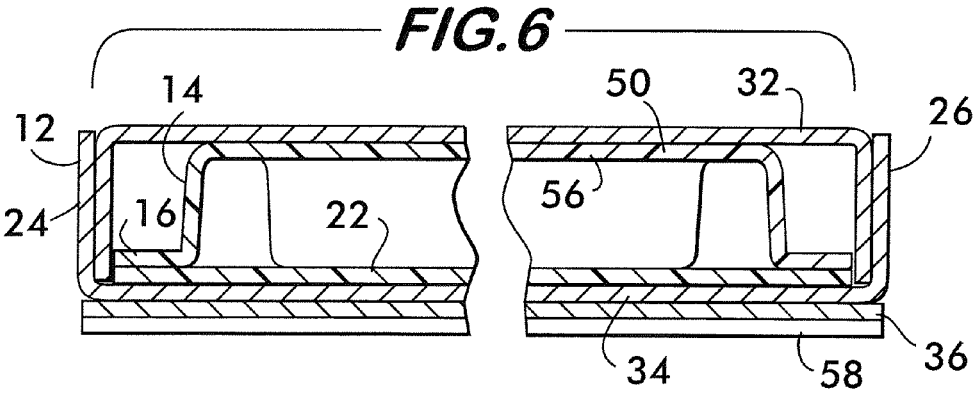
FIG. 6 is a cross-sectional view of the package of FIG. 1 along line 6-6 of FIG. 5.
Figure 7:
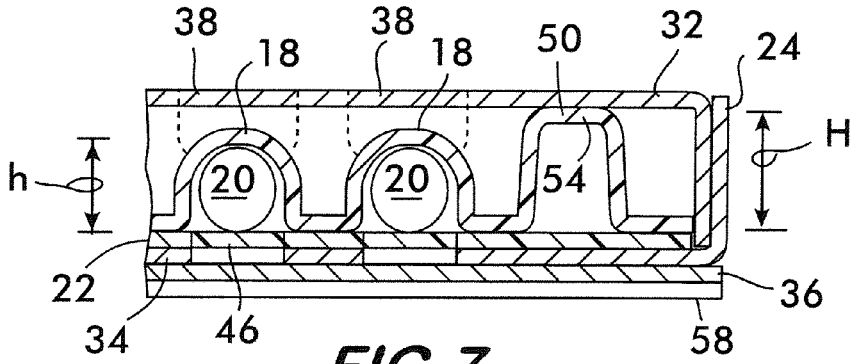
FIG. 7 is a cross-sectional view of the package of FIG. 1 along line 7-7 of FIG. 5.

As best shown in FIGS. 5-7, the opposed end portions 52 and 54 and the spine portion 56 of the rib 50 can be hollow and molded from the card 16 of the blister card 14. Thus, the rib 50 may be formed in a similar manner as the blister compartments 18 and at the same time the blister compartments are molded. As best shown in FIGS. 5 and 7, the rib 50 may have a greater height "H" than that of the height "h" of the blister compartments 18 and may extend the full height of the sidewalls 28 and 30 for purposes of engaging the first and second wall panels, 32 and 34. Thus, the rib 50 provides a support column extending between the first and second wall panels 32 and 34. In addition, the greater height "H" of the rib 50 ensures that a tab 38 must first be torn away before pressure can be applied to a blister compartment 18. Thus, the rib 50 prevents pressure from being applied to a blister compartment when the tab 38 above the blister compartment is sealed in placed.

In one contemplated embodiment, the outer sleeve 12 is made from a blank of paperboard or like sheet material. For example, the sheet material can be a SBS (solid bleached sulfate) paperboard stock material of a desired thickness. This type of material can be provided in a relatively flat blank form on which panels, fold lines, cutouts, openings, perforations, or the like can be readily formed, die cut, and/or defined.

The material of the blank may be capable of being coated with a continuous or discontinuous layer of a heat and/or pressure activated adhesive at desired locations for purposes of forming the sleeve or carton shape. For instance, adhesive may be provided at locations corresponding to the end-wall flaps forming the end-walls, 24 and 26, and at a side flap 58 used to form the hollow outer sleeve configuration. Further, certain sides of the blank may be provided as being glossy or otherwise of a desired texture and/or appearance for forming the visible external surfaces of the package 10.

Although the use of paperboard is discussed above, it should be understood that other materials can also be utilized, such as, molded materials, composite materials, multilayered materials, plastic materials, metal foils, paper, or the like. According to one contemplated embodiment, the materials used to form the package 10 are recyclable materials such that after all tablets have been dispensed from the package, the package 10 can be recycled in its entirety.

Various modifications to the package and its method of assembly can be used. For instance, the number, shape and configuration of the various panels and flaps of the blank forming the outer sleeve 12 can be altered. The shape, size and/or pattern of the perforations, cutouts, tabs, chads, and the like can be changed. Different types of adhesives and other means to bond the panels of the carded package together can be used. Different materials within a range of different thicknesses can be used. The shape, location and configuration of the blister compartments, chads, tabs, and support rib of the blister card can be altered.

While a package and method of manufacture have been described in detail, various modifications, alterations, and changes may be made without departing from the spirit and scope of the package and method according to the present invention as defined in the appended claims.

The invention claimed is:

1. A child-resistant package for a plurality of items, comprising:

an outer protective sleeve made of paperboard and having opposed, spaced-apart first and second wall panels, said first wall panel having a series of separate tear-away tabs each including an end tip for use in initiating peeling of said tear-away tabs from said first wall panel; and a separate card contained in a stationary position within and relative to said outer protective sleeve and having a plurality of separate, spaced-apart hollow compartments and a hollow reinforcement rib, each of said spaced-apart hollow compartments being sized to contain one of the plurality of items, said separate card being a blister card and said spaced-apart hollow compartments being upstanding blister compartments, and said blister card including a backing behind said upstanding blister compartments and including a transparent and substantially planar card material made of thermoplastic material having been molded to form said upstanding blister compartments and said hollow reinforcement rib integrally from said blister card material; and a series of separate push-through chads aligned with said upstanding blister compartments opposite said tear-away tabs and provided on or carried by said second wall panel;

each of said tear-away tabs being sized such that removal of one of said tear-away tabs exposes a top of only a corresponding one of said upstanding blister compartments;

said hollow reinforcement rib consisting of an I-shaped rib having a spine portion extending centrally along a length of said blister card between two rows of said upstanding blister compartments formed on said blister card and opposite transverse end portions extending along opposite ends of said blister card, each of said opposite transverse end portions having a pair of free terminal ends; and said outer protective sleeve including an integral cover flap that pivots between a closed position and an open position, such that, when said integral cover flap is in said closed position, wherein said integral cover flap prevents said series of separate push-through chads from being pushed through and ruptured.

2. The package according to claim 1, wherein each of said tear-away tabs is defined by perforations in said first wall panel.

3. The package according to claim 1, wherein said paperboard is solid bleached sulfate paperboard.

4. The package according to claim 1, wherein said items are selected from the group consisting of pills, tablets, candy, vitamins, supplements, and doses of medicine.

5. A child-resistant, senior-friendly package for tablets, comprising:

an outer protective sleeve made of paperboard and having opposed, spaced-apart first and second wall panels, opposed end-walls, and opposed sidewalls forming a closed carton, said first wall panel having a series of separate tear-away tabs, and said second wall panel providing a series of chads, each of said chads being directly opposed and aligned with one of said tear-away tabs, and each of said tear-away tabs being defined by perforations in said first wall panel and including an end tip extending on one of the sidewalls of the outer protective sleeve for use in initiating peeling of said tear-away tab from said first wall panel; and a separate blister card captured in a stationary condition relative to and within said outer protective sleeve, said blister card having a plurality of separate, spaced-apart, upstanding, hollow blister compartments, a reinforcement rib, and a backing behind said spaced-apart hollow upstanding blister compartments;

each of said spaced-apart hollow upstanding blister compartments being sized to contain one of the tablets and each of said tear-away tabs being sized such that removal of one of said tear-away tabs exposes an upper wall of only one of said spaced-apart hollow upstanding blister compartments;

said reinforcement rib providing a column support for maintaining a pre-determined amount of spacing between said opposed, spaced-apart first and second wall panels and being of a height greater than a height of said spaced-apart hollow upstanding blister compartments;

each of said spaced-apart hollow upstanding blister compartments being located directly between and aligned with one of said chads and one of said tear-away tabs;

said reinforcement rib providing a pre-determined amount of spacing between said tear-away tabs and upper walls of said spaced-apart hollow upstanding blister compartments;

said reinforcement rib consisting of an I-shaped rib having a spine portion extending centrally along a length of the blister card between two rows of said spaced-apart hollow upstanding blister compartments formed on the blister card and opposite transverse end portions extending along opposite ends of the blister card; and said outer protective sleeve including an integral cover flap that can be pivoted between a closed position in which said integral cover flap covers said second wall panel and conceals said chads and an open position in which said second wall panel and said chads are exposed, when said integral cover flap is in said closed position, wherein said integral cover flap prevents said chads from being pushed through and ruptured.

* * * * *